United States Patent [19]

Boykin

[11] Patent Number: 4,695,081

[45] Date of Patent: Sep. 22, 1987

[54] VENT WINDOW SECURING DEVICE FOR VANS AND TRUCKS

[76] Inventor: Richard C. Boykin, 262 7th Ave., New York, N.Y. 10001

[21] Appl. No.: 663,661

[22] Filed: Oct. 19, 1984

[51] Int. Cl.[4] ..... E05C 13/02

[52] U.S. Cl. ..... 292/96; 292/DIG. 6

[58] Field of Search ..... 292/96, 258, 142, 172, 292/DIG. 6, 39, 122; 70/211, 212

[56] References Cited

U.S. PATENT DOCUMENTS

| | | | |
|---|---|---|---|
| 1,892,512 | 12/1932 | Kemp | 292/142 X |
| 2,238,754 | 4/1941 | Rupp | 292/142 X |
| 2,575,401 | 11/1951 | Simmons | 70/211 |
| 3,722,935 | 3/1973 | Lalib | 292/DIG. 6 X |
| 4,268,073 | 5/1981 | Hibbert | 292/DIG. 6 X |

*Primary Examiner*—Richard E. Moore

[57] ABSTRACT

A vent window securing device adapted to be mounted on a van or truck door having a vent window. The securing device includes a flat support member that is attached to the inside of the front door by the same bolts that hold the window regulator to the door. An adjustable vertical gear member has a top portion having a U-shaped clamp that fits over the latch of the vent window in the horizontal position. The bottom portion of the vertical gear member has vertical gear teeth that mesh with the teeth of a circular gear that is connected to the flat support member by a shaft having a handle that can be rotated. The U-shaped clamp can be attached to a vertical steel rod having a threaded bottom that is adjustable with the vertical gear member by a flange and nut connector. An alternative embodiment provides an upwardly facing clamp under the vent window that is clamped to the window by a downwardly facing clamp attached to the top of the steel rod.

8 Claims, 5 Drawing Figures

VENT WINDOW SECURING DEVICE FOR VANS AND TRUCKS

This invention relates to an anti-burglary device for automotive vehicles, and more particularly to a device for securing the vent window of a motor vehicle from being forced open.

BACKGROUND OF THE INVENTION

As theft of and from motor vehicles increases, van and truck owners are becoming more concerned with their security problems. The prevention of buglary and theft can be achieved only with the type of protection that thwarts burglars and thieves completely. Van and truck owners have long been aware of the inadequacy and ineffectiveness of their standard vent window latches attached by manufacturers. Various types of devices have been advanced to prevent thieves from breaking in through vent windows. However, many of these devices are objectionable from the standpoint that they are either expensive, not effective, or complicated to install. The gadgets that are being used today can easily be defeated with a screw driver or a pry bar and in some cases with the bare hands. Any amateur thief can break into a van through a vent window in less than three seconds thereby allowing him to steal the entire van or any part of its contents in less than five minutes. The disadvantage of present day inventions lies primarily in their installation configurations and in their physical size. Likewise, electronic alarm systems do not prevent burglary and theft, since these systems merely send out alarms.

In response to the above problems, the applicant has invented a device that is relatively inexpensive to manufacture and easy to install. It requires no drilling of new holes when it is attached to the vehicle door. In contrast to present day inventions this unique device is designed to fit a van or truck door of any year, make, model, and either the left or right side door. Present inventions do not have the dependability, durability, reliability, and ruggedness of the proposed invention.

SUMMARY OF THE INVENTION

Accordingly, it is the general object of the present invention to provide a novel device which overcomes all of the of the foregoing problems.

It is an object of this invention to provide a vehicle vent-window-lock securing device which can be installed on a vehicle door which has a hand-operated window adjacent to it on the same door securing the vent window without the drilling new hole in the door.

It is another object of this invention to provide a novel securing device which is adapted to be mounted on the flat plane of the van door.

Yet another object of this invention is to provide a novel securing device that will also enhance the interior of the vehicle and can be readily mounted on the door and that will not mar or otherwise damage the door.

It is still another object of the present invention to provide a vent door securing device that can be designed to fit any manufacturer's vehicle, model, or year of manufacture.

Yet another object of the present invention is to provide a novel securing device of the character described above which can be adjusted to different positions.

A more particular object of the present invention is to provide a novel securing device of the foregoing character which can also be effective even when the vent window lock is broken, or missing, or inoperative because of a previous forced entry.

Still another object of this invention is to provide a novel securing device of the character described which is simple in construction, economical to manufacture, and reliable in operation.

An additional object of this invention is to discourage would-be burglars of vans and trucks by providing a securing device that cannot easily be overcome or have its purposes defeated.

Another additional object of this invention is to visibly display a locking device on a van or truck door in such a manner so as to reveal the true strength of the device.

Still another object of this invention is to assume massive strength for a vent window locking device by way of utilizing the same holes in the door for installing the window regulator itself.

Other objects and advantages of the present invention will become apparent from the following detailed description and accompanying drawings.

DETAILED DESCRIPTION OF THE INVENTION

Figure 1:
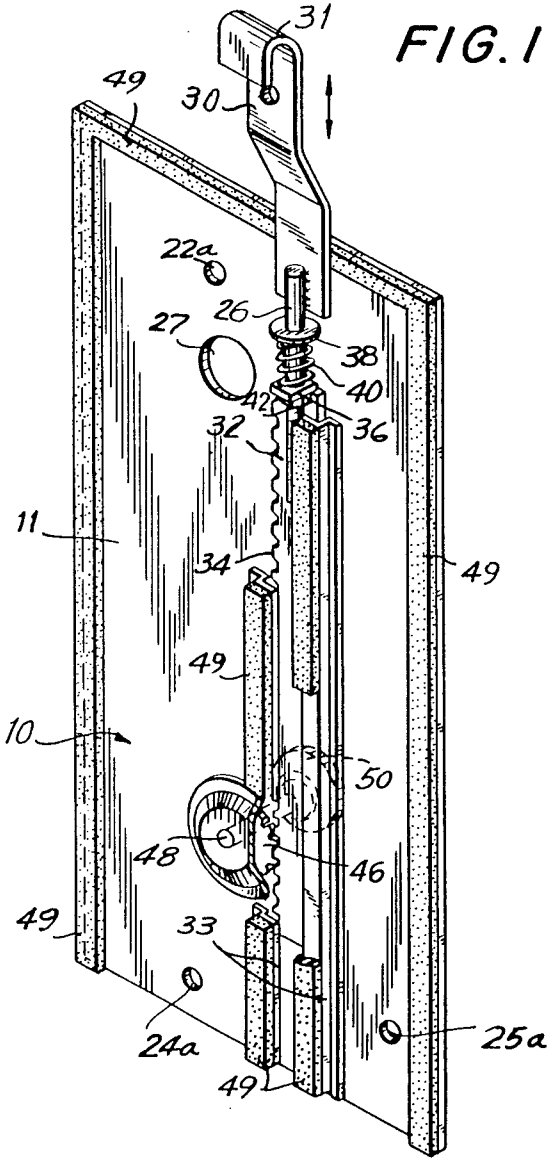
FIG. 1 is a three-dimensional view of vent-window locking device that generally embodies the features of the present invention as well as giving a perspective view of its detailed elements.
Figure 2:
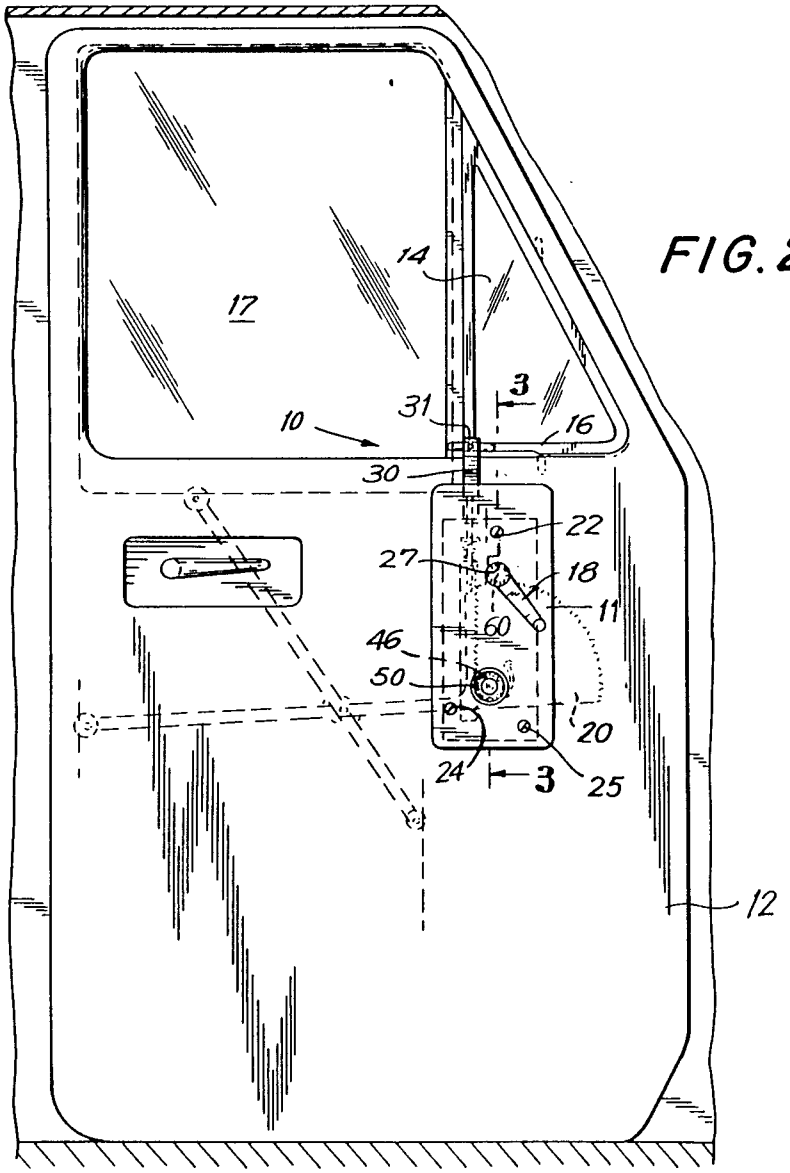
FIG. 2 is an elevational view of the securing device embodying the features of the present invention showing the device as is appears in use and mounted on the vehicle door.
Figure 3:
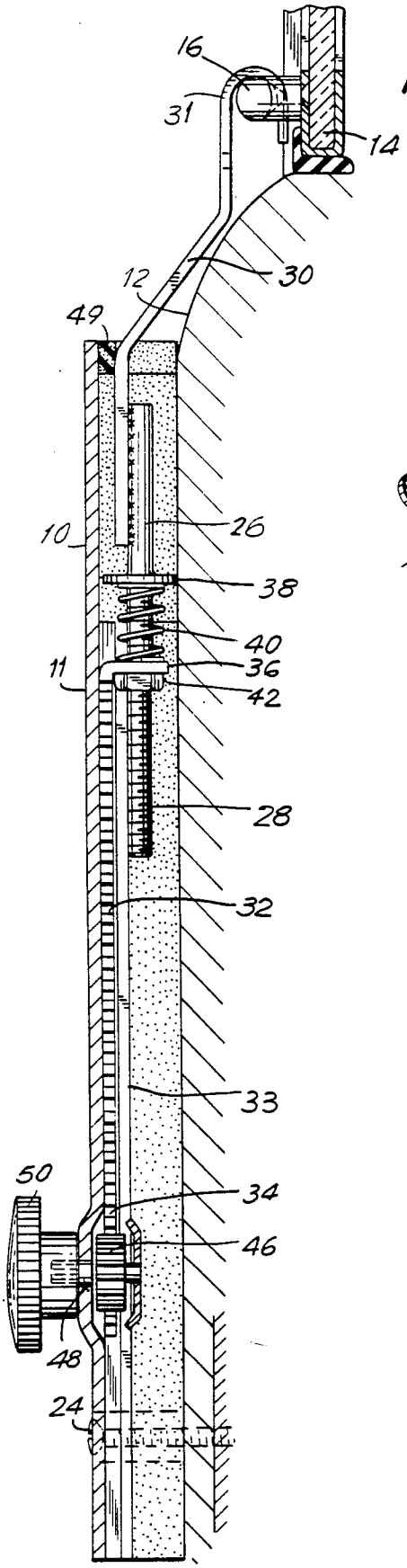
FIG. 3 is a side sectional view of the device as shown in FIG. 1.

A van vent-window locking system 10 shown in FIGS. 1 and 2 includes a flat support plate 11 secured to the inside of the left door 12 of a van. A vent window 14 is opened and closed in the usual manner by a vent window latch 16, which is approximately horizontal when vent window 14 is closed. The side window 17 of the van is controlled by a side window handle 18 of a window regulator 20 shown in dotted lines positioned within door 12 by way of a side window handle 20. Window regulator 20 is secured to door 12 by an upper bolt 22 and two lower bolts 24 and 25. Support plate is held to door 12 by the same bolts 22, 24, and 25. FIG. 1, which shows the inner side of support plate 11 in isolation, shown three bolt holes **22*a*, 24*a*, and 25*a*, which are adapted to receive bolts 22, 24, and 25, and further shows an aperture 27 adapted to pass the shaft of window handle 18. A vertical steel rod 26 positioned adjacent to support plate 11 includes a lower threaded portion 28 and an upper portion connected to the lower end of an elongate, flat, steel member 30 having a flat, U-shaped locking portion 31, which is oriented outwardly relative the van towards vent window 14. A vertical gear member 32 slidably positioned in a pair of opposed vertical channels 33 attached to support plate 11 includes vertical gear teeth 34. As seen in FIG. 3, the top of vertical gear member 32 has an inwardly extending flange 36 having a vertical hole adapted to receive threaded portion 28 of rod 26** in adjustable relationship.

Rod 26 includes a ring 38 shown spaced above flange 36 in FIGS. 1 and 3. A compression spring 40 is positioned around rod 26 between flange 36 and ring 38. A locking nut 42 is threaded onto the bottom of rod 26 and presses against the bottom of flange 36. The degree to which rod 25 extends above or below flange 36 is predetermined by the distance nut 42 is threaded onto rod A circular gear having gear teeth 46 rotatably mounted to support plate 11 by a horizontal shaft 48 engages vertical teeth 34 of vertical gear member 32. A handle 50 connected to shaft 48 is positioned inside the van proximate support plate 11 is capable of being rotated so as to rotate circular gear 46 in a clockwise or counterclockwise direction. When circular gear 46 is rotated counterclockwise, vertical gear member 32 is forced upwardly; and when circular gear 46 is rotated clockwise, vertical gear member 32 is forced downwardly.

In order to prevent jarring or marring, or damage to door 12 when support member 11 is mounted thereon, a cushioning material may be provided on parts of 11 which engage door 12. For example, a strip of rubber 49 or other suitable material may be cemented to the rear vertical and horizontal edges of support member 11.

In operation, support plate 11 is first mounted to door 12. Then rod 26 is positioned through the hole in flange 36 and U-shaped locking portion 31 is placed over vent-window latch 16. Locking nut 42 is then screwed onto threaded portion 28 of rod 26 until it meets flange 36 at the position that has been predetermined to generally secure latch 16 within U-shaped locking portion 31. Finally handle 50 is rotated counterclockwise to draw vertical gear member 32 downwardly so as to pull rod 26 downwardly and thus draw U-shaped locking portion 31 tightly down against latch 16.

Figure 4:
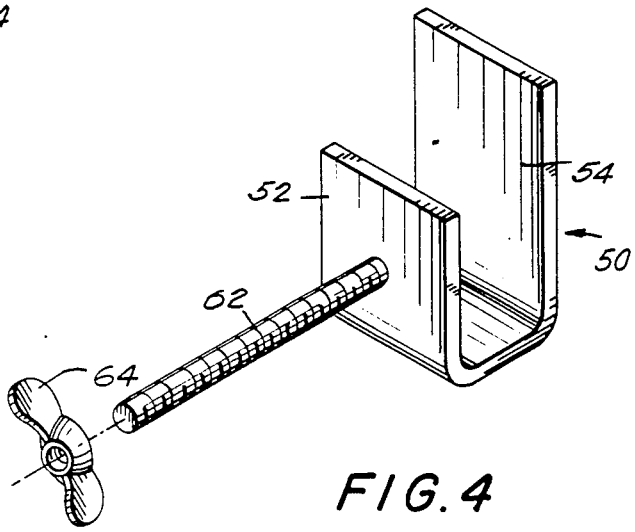
FIG. 4 is a perspective view of a securing element.
Figure 5:
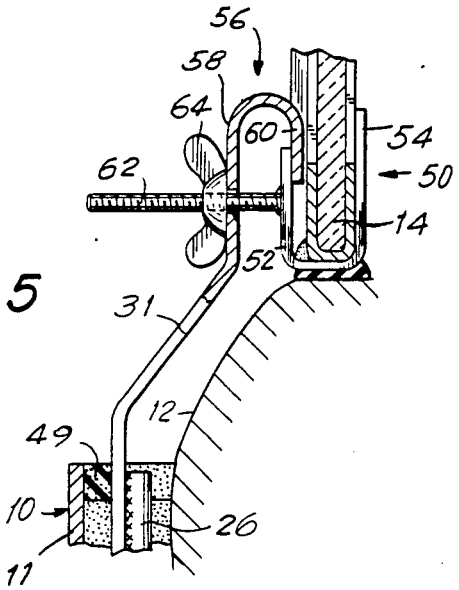
FIG. 5 is a side sectional view of securing elements.

FIGS. 4 and 5 show an alternative embodiment of the invention. An upwardly facing U-shaped clamp member 50 shown in FIGS. 4 and 5 is adapted to fit under vent window 14. Clamp member 50 includes inner and outer walls 52 and 54, respectively, relative to the vent window joined by a bottom portion. Inner wall 52 and vent window 14 form a space therebetween. A downwardly facing U-shaped clamp portion 56 having inner and outer sides 58 and 60, respectively, joined by a top portion is positioned at the top of steel rod 26. Outer side 60 is positioned in the space between vent window 14 and inner wall 52. Inner side 58 has a bolt hole. A threaded bolt 62 is connected to inner wall 52 extends horizontally through the bolt hole to the inside of vehicle. A nut 64 is removably threaded onto bolt 62 to a locking position abutting inners side 58 of clamp portion 56 so as to removably clamp clamp portion 56 against U-shaped clamp member 50.

While certain specific embodiments of the invention have been herein illustrated and described, it will be understood that modification and variations thereof may be effected without departing from the scope of the invention as set forth in the appended claims.

I claim:

1. A vent window securing device mounted on a van or truck door having a vent window frame and a vent window mounted in the frame movable between open and closed positions, a locking latch connected to the frame for holding the vent window in a closed position when in a generally horizontal position, and an interior flat vertical surface, comprising, a flat support member secured to the interior flat surface of the door, an elongated vertical member attached to said support member and having opposed upper and lower portions and movable between raised and lowered positions, said vertical member having vertical gear teeth formed at said lower portion, a circular gear member having circular gear teeth engaged with said vertical gear teeth and rotatably secured to said support member, locking means mounted at said upper portion of said elongated member for securing the vent window in the closed position, and rotating means connected to said circular gear member for rotating said circular gear teeth so as to gear said vertical member between said raised and lowered positions, wherein in said lowered position said locking means holds the vent window in said closed position and in said raised position said locking means releases the vent window from said closed position.

2. A securing device according to claim 1, wherein a window regulator apparatus including a window regulator handle having a generally horizontal shaft is mounted to the flat vertical surface of the door by bolts and wherein said support member has a plurality of bolt holes adapted to receive the bolts of the window regulator handle and an aperture through which the shaft of the window regulator passes, said support member being secured by the bolts.

3. A securing device according to claim 1, wherein said locking means includes a downwardly and outwardly facing U-shaped clamp connected to said upper portion of said vertical member, said U-shaped clamp holding said latch in the horizontal position when said vertical member is in said lowered position.

4. A securing device according to claim 3, wherein said locking means further includes an upwardly facing U-shaped clamp member adapted to fit under the vent window and having inner and outer walls relative to said vent window, said inner wall and said vent window forming a space therebetween; said vertical member including a downwardly facing U-shaped clamp portion having inner and outer sides, said outer side being removably positioned into said space between said vent window and said inner wall when said vertical member is in said raised position, said inner side forming a bolt hole; a threaded bolt connected to said inner wall and extending horizontally through said bolt hole; and a nut removably threaded onto said bolt to a locking position abutting said inner side so as to removably clamp said U-shaped clamp portion against said U-shaped clamp member.

5. A securing device according to claims 3 and 4, further including means for adjusting said upper portion of said vertical member relative said lower portion.

6. A securing device according to claim 5, wherein said means for adjusting includes said upper portion having a bottom portion configured as a rod having threads and said lower portion having a top portion having a flange forming a hole adapted to pass said rod, said rod having a ring located above said flange, a compression spring being positioned between said ring and said flange, and a nut threaded onto said rod so as to press upwardly against said flange at a preselected position wherein said compression spring is pressed to a biased mode.

7. A securing device according to claim 4, wherein said rotating means includes a horizontal shaft rotatably connected to said circular gear and a handle attached to said shaft spaced from said support member.

8. A securing device according to claim 7, wherein said mounting means is a pair of opposed channels slidingly supporting said support member.

* * * * *